US007150358B2

(12) United States Patent
Carr et al.

(10) Patent No.: US 7,150,358 B2
(45) Date of Patent: Dec. 19, 2006

(54) SHAKER SCREEN CLAMPING AND SEALING ASSEMBLY

(75) Inventors: Brian Carr, Burlington, KY (US); Ari Hukki, Boynton Beach, FL (US)

(73) Assignee: M-I L.L.C., Houston, TX (US)

( * ) Notice: Subject to any disclaimer, the term of this patent is extended or adjusted under 35 U.S.C. 154(b) by 44 days.

(21) Appl. No.: 11/116,508

(22) Filed: Apr. 28, 2005

(65) Prior Publication Data

US 2005/0258080 A1 Nov. 24, 2005

Related U.S. Application Data

(60) Provisional application No. 60/566,654, filed on Apr. 30, 2004.

(51) Int. Cl.
*B07B 1/49* (2006.01)

(52) U.S. Cl. ..... 209/403; 209/399; 209/405; 277/644; 277/638; 277/921

(58) Field of Classification Search ..... 209/399, 209/403, 405; 277/638, 644, 921
See application file for complete search history.

(56) References Cited

U.S. PATENT DOCUMENTS

| | | | | |
|---|---|---|---|---|
| 5,452,529 | A * | 9/1995 | Neuenfeldt et al. | 37/455 |
| 5,811,003 | A * | 9/1998 | Young et al. | 210/388 |
| 6,401,935 | B1 * | 6/2002 | Wiseman | 209/403 |
| 2004/0245153 | A1 * | 12/2004 | Seyffert et al. | 209/372 |
| 2004/0251174 | A1 * | 12/2004 | Seyffert et al. | 209/309 |

* cited by examiner

*Primary Examiner*—Gene O. Crawford
*Assistant Examiner*—Terrell Matthews
(74) *Attorney, Agent, or Firm*—M-I L.L.C.

(57) ABSTRACT

An assembly for sealing a shaker screen assembly in a shaker separator includes a substantially inflexible gasket affixed to each screen support and a flexible gasket affixed to each screen support such that the screen frame rests atop the gaskets on the support around its periphery. A wedge block retainer bracket is affixed to each side wall of the shaker separator above the corresponding section of the screen frame. A wedge block is selectively drivable into the space between the wedge block retainer bracket and the corresponding section of the screen frame, providing force thereto sufficient to seat the screen frame against the inflexible gasket and to compress the flexible gasket between the screen frame and the screen support, thereby providing a substantially fluid tight seal.

17 Claims, 7 Drawing Sheets

SHAKER SCREEN CLAMPING AND SEALING ASSEMBLY

This application claims the benefit of U.S. Provisional Application No. 60/566,654, filed Apr. 30, 2004 the contents of which are incorporated herein by reference. New matter has been added to this specification for which priority is not claimed.

BACKGROUND OF INVENTION

Rotary drilling methods employing a drill bit and drill stems have long been used to drill wellbores in subterranean formations. Drilling fluids or muds are commonly circulated in the well during such drilling to cool and lubricate the drilling apparatus, lift drilling cuttings out of the wellbore, and counterbalance the subterranean formation pressure encountered. The recirculation of the drilling mud requires the fast and efficient removal of the drilling cuttings and other entrained solids from the drilling mud prior to reuse. Shaker separators are commonly used to remove the bulk solids from the drilling mud.

As is illustrated in FIG. 1 the current state of the art method for securing the shaker screen (2) to the shaker separator (not fully shown) involves the use of a wedge block retainer bracket (4) which is an integral part of the shaker separator and a wedge block (6). As one of skill in the art should know, the screen is placed in position underneath the wedge block retainer bracket and then the wedge block is pounded into position so as to secure the screen to the shaker separator. One of skill in the art should appreciate that the shaking motion of the shaking separator can cause the loosening of the wedge block if the wedged block is not fully secured. Given the current state of the art design, anecdotal accounts suggest that the operator often chooses to use a combination of a hammer and a suitable piece of wood in contact with the wedge block to deliver sufficient force to fully secure the wedge block. Unless care is used, premature physical damage to the screen and/or the wedge block may occur. It will also be appreciated by one of skill in the art that removal of a fully secured prior art wedge block is not a trivial operation.

Often removal of the wedge block involves the use of a pry bar engaged into the teeth (8) of the wedge block (6) and pivoted against a pivot point (not shown). Unless high levels of care are used, anecdotal accounts of this activity suggest that the potential for physically damaging the wedge block, physically damaging the screen, physically damaging the shaker and/or causing injury to the operating personnel is substantial. Thus there exists a continuing need for improved designs in the retention of the screen to the shaker and the wedge blocks that are used in such an operation.

A gasket is mounted to the shaker separator to seal the interface between the shaker screen and the support ledge of the shaker separator. The gasket sometimes is mounted to the support ledge using screws through the gasket into the support ledge. More often, the gaskets are mounted to the support ledge with through bolts. Because the gasket is subjected to abrasion and other damage as a result of being in direct contact with drilling fluids and solids, the gasket must be replaced from time to time. Removal of gaskets that are screwed or bolted to the support ledge often require grinding off the head of each fasteners used to mount the gasket to the support ledge as the heads are too worn to use common removal tools. This is considered "hot work" and can be undertaken only when the area is clear from explosive conditions, such as flammable liquids and fumes which could be ignited by sparks from the grinding process. It would be an improvement in the art to have a gasket mounted to a support ledge in such a way that the gasket may be removed without requiring "hot work" activities to be performed.

SUMMARY

The present disclosure is generally directed to a means for forming a seal between a shaker separator and a shaker screen.

An assembly for sealing a shaker screen assembly in a shaker separator includes a substantially inflexible gasket affixed to each screen support and a flexible gasket affixed to each screen support such that the screen frame rests atop the gaskets on the support around its periphery. A wedge block retainer bracket is affixed to each side wall of the shaker separator above the corresponding section of the screen frame. A wedge block is selectively drivable into the space between the wedge block retainer bracket and the corresponding section of the screen frame, providing force thereto sufficient to seat the screen frame against the inflexible gasket and to compress the flexible gasket between the screen frame and the screen support, thereby providing a substantially fluid tight seal.

The flexible gasket is affixed to the screen support with a screw and grommet configuration such that the flexible gasket may be removed by prying it from the support ledge.

Additional details and information regarding the claimed subject matter can be found in the following description.

BRIEF DESCRIPTION OF THE DRAWINGS

The present disclosure is made with reference to the following Figures.

DETAILED DESCRIPTION

Figure 1:
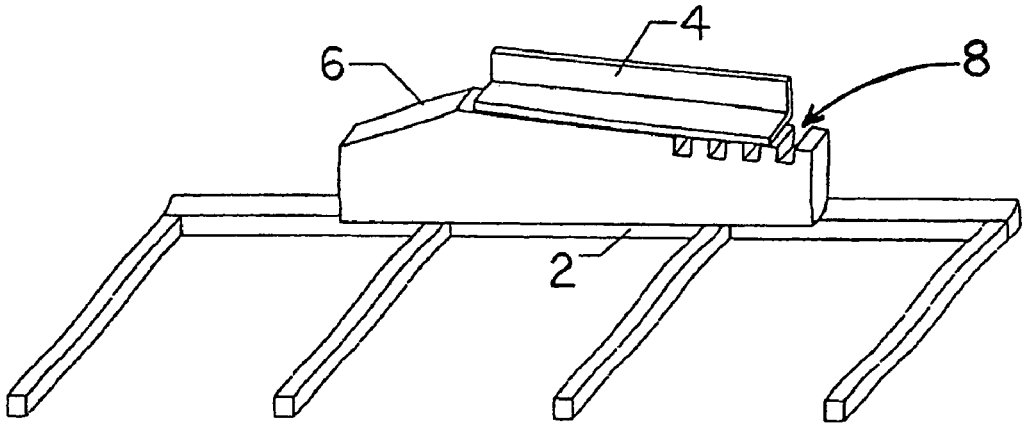
FIG. 1 (Prior Art)
FIG. 1, is a diagram illustrating the interactions of a state of the art (prior art) screen frame with a wedge block and a wedge block retaining bracket of a shaker separator.
Figure 2:
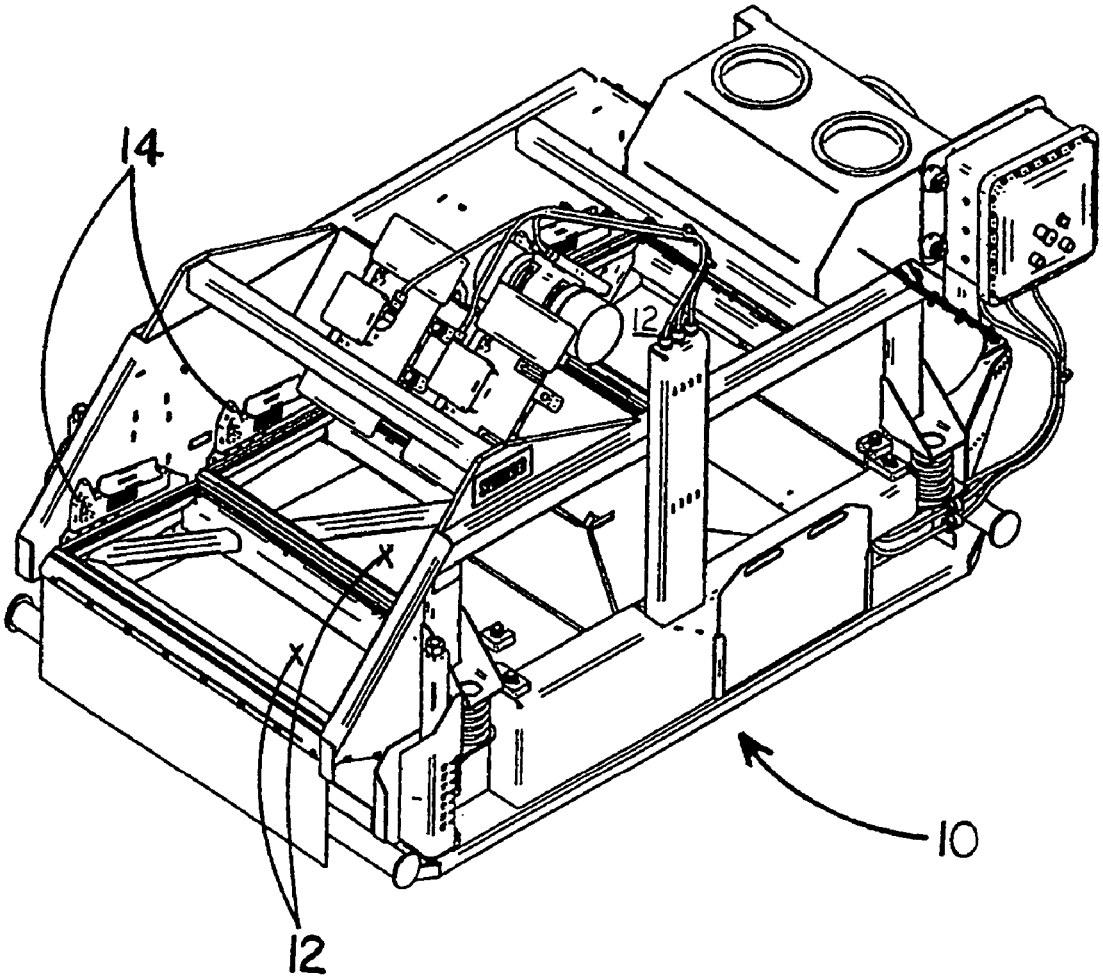
FIG. 2 is a perspective view of a shaker separator incorporating the wedge block and clamping and sealing assembly as disclosed herein.

The present disclosure is generally directed to improved means for securing a shaker screen to a shaker separator. With reference to FIG. 1, shown is an illustrative embodiment of a shaker separator (10) incorporating various aspects of the claimed subject matter. As can be seen in FIG. 2, one or more shaker screens (12) are secured to the shaker separator (10) using one or more improved wedge block (14) as will be substantially described herein. Because of the perspective view of FIG. 2, some of the separator screens (12) and wedge blocks (14) are not visible, however, it should be appreciated that in the illustrative embodiment, there are four separator screens (three of which are identified) and eight wedge blocks (two of which are identified) in the apparatus shown in FIG. 2. It should also be immediately apparent to one of skill in the art that FIG. 2 is representative of the physical circumstances and constraints typically encountered by an operator of a shaker separator used in drilling operations.

Such conditions may include operation in a closed room below decks in an off shore drilling rig or drilling boat, the presence of fluids (primarily drilling fluids) and solids (drill cuttings) on the equipment and other conditions which should be well known to one of skill in the art. Further it will be appreciated that for illustration purposes this figure, as do the other figures in this description, omits the actual screening elements for clarity purposes only. Finally it will be appreciated by one of skill and knowledge in the art that the illustrated shaker (i.e. a M-I SWACO MONGOOSE PT™) has been presented as a representative of a general class of shaker separators upon which the claimed subject matter may be applied.

Figure 3:
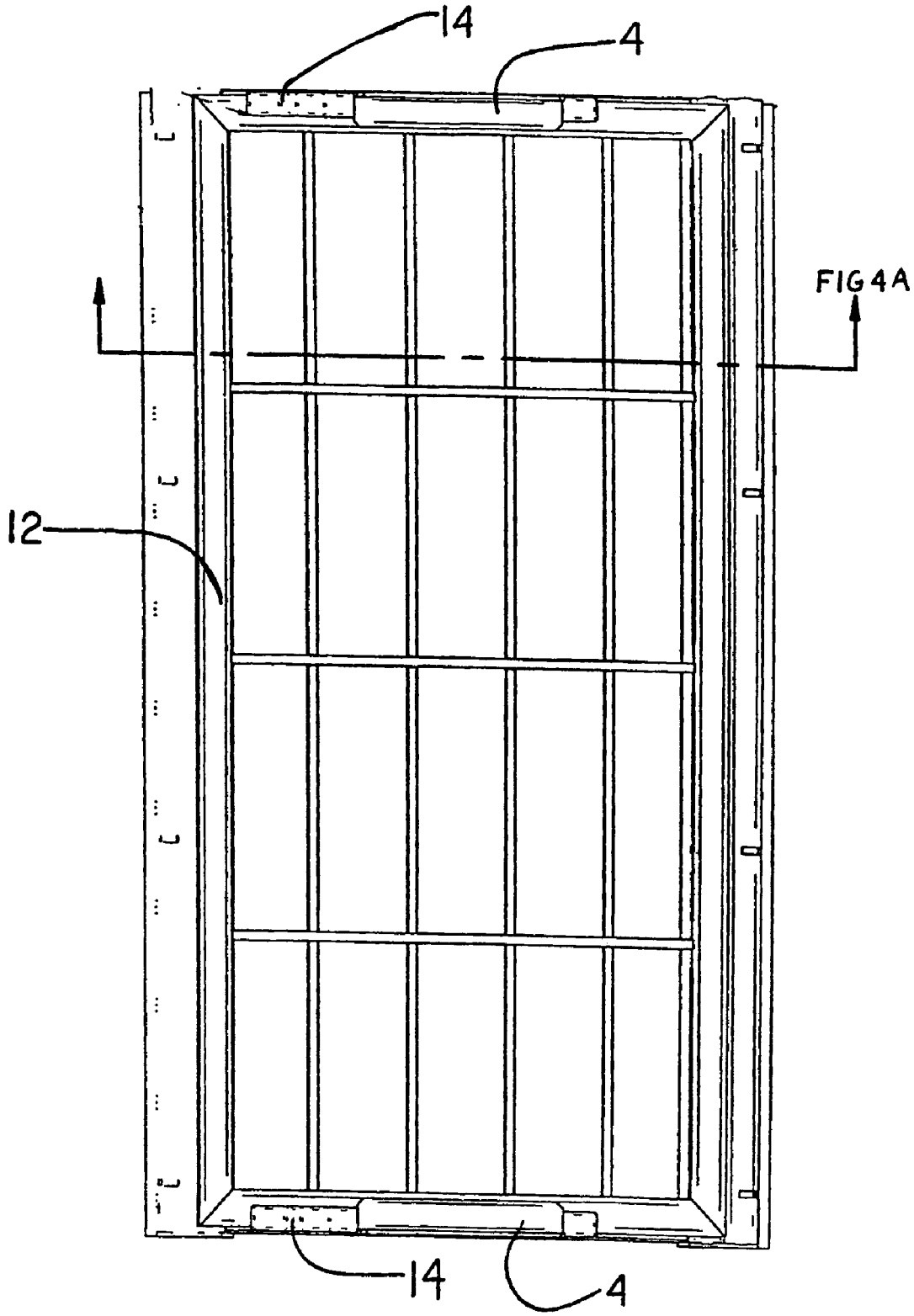
FIG. 3 is a top view of a screen frame with a wedge block and a wedge block retaining bracket of a shaker separator as disclosed herein.

Turning now to FIG. 3, illustrated is a top view perspective of a shaker screen (12) secured to a shaker separator (surrounding but not show) with a pair of wedge blocks (14) as described herein. The wedge block retainer bracket (4) is also included. As should be noted by one of skill in the art, the preferred embodiment of the wedge block has a width that is substantially similar to that of the wedge retainer bracket. This is desirable as it maximizes the available surface area of frictional contact between the wedge retainer bracket and the wedge block itself. Further this arrangement maximizes the available surface area exposed on the shaker screen. Even though the illustrated arrangement in FIG. 3 is that of a preferred embodiment, one of skill in the art should appreciate that the size of the wedge block may be increased or decreased. It should also be noted that while only one pair of wedge blocks are used in the illustrative embodiment, this number of wedge blocks may vary from one to eight or more depending upon the design of the shaker separator, the size and positioning of the wedge block and wedge block retainer bracket relative to each other as well as other factors that should be well known to one of skill in the art.

Figure 4A:
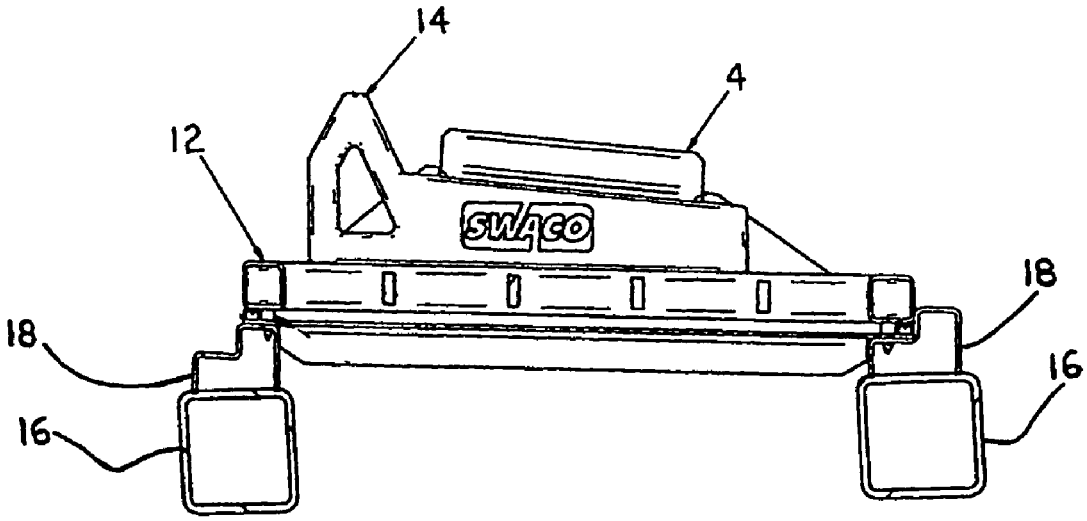
FIGS. 4A and 4B are lateral cross sectional views of a screen frame with a wedge block and a wedge block retaining bracket of a shaker separator as disclosed herein.
Figure 4B:
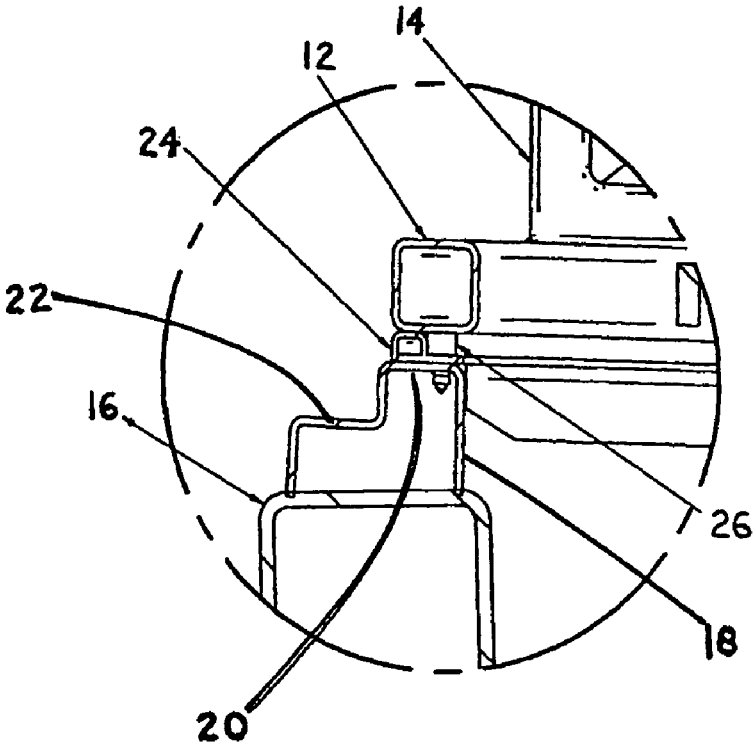

With reference now to FIG. 4A and FIG. 4B, shown is a lateral cross-sectional view along the line in FIG. 3, with FIG. 4B being a detailed view of the left edge of FIG. 4A. Shown in FIG. 4A, the shaker screen (12) is held in place by the wedge block (14) working in frictional cooperation with the wedge block retainer bracket (4). The shaker separator includes a supporting cross member (16) upon which a shaker screen support (18) is mounted. Each of the shaker screen supports (18) includes an upper support ledge (20) and a lower support ledge (22) which is better illustrated in FIG. 4B.

As shown in FIG. 4B, the frame of the shaker screen (12) is in sealing contact with a flexible gasket seal (24) (also referred to as the soft gasket) and a substantially inflexible gasket seal (26) (also referred to as the hard gasket) which are mounted on the upper support ledge (20) of the shaker screen support (18). This sealing contact is maintained by the pressure and frictional contact between and amongst the wedge block, the wedge block retainer bracket (4) and the frame of the shaker screen (12). As should be apparent to one of skill in the art, both the soft gasket and the hard gasket are substantially coextensive with the length of the shaker screen support, which in turn is sized to substantially correspond to the size of the shaker screen. The concept of the interaction between the illustrated elements is to provide a sealing means between the shaker screen and the frame of the shaker separator so that fluids or other materials being separated do not by pass, leak through or break through the separation process. One of skill in the art should appreciate that one of the advantages of the presently illustrated embodiment is that the benefits of a soft gasket (i.e. substantially fluid tight seal) and a hard seal (i.e. frictional connectivity) are achieved by the combination of the two types of seals. That is to say, the soft seal forms a substantially fluid tight connection between the shaker screen and the shaker screen support while at the same time the hard seal provides for the spacing and support needed to effectively secure the shaker screen to the shaker separator. Thus this combination of sealing types allows for a substantially fluid tight seal combined with the rigidity needed to prevent the screen from loosening during operation of the shaker separator. Although the illustrative embodiment utilizes only one soft gasket and one hard gasket, an obvious variation of this design would be to utilize one or more soft gaskets alone or in combination with one or more hard gaskets. Further it should be noted that the relative order of the two gaskets as shown (i.e. the soft gasket outside of the hard gasket) may also be varied without substantially changing the desired result.

One of skill in the art should also note that the shaker screen as shown in FIG. 4A is at a slight angle. The angle is formed by one side of the screen being mounted to the upper support ledge and the other end of the screen being mounted on the lower support ledge. It should be appreciated by one of skill in the art that the slight angle of the screen promotes the separation process when the angle is against the flow of the material being separated. That is to say the flow of material to be separated would flow from right to left for the configuration shown in FIG. 4A. Another of the many advantages of the arrangement shown in FIG. 4A is that when a plurality of screens are mounted in series, a substantially continuous screening surface is created. For example if the screen shown in FIG. 4A is designated as a middle screen, a screen mounted to the left side of the figure would have its right most edge secured to the lower support ledge (22) of the left side shaker screen support. Similarly a screen to the right of that shown would have its left most edge secured to the upper support ledge (20) of the right side shaker screen support. As noted such an arrangement of screens creates a substantially continuous screening surface.

Figure 5A:
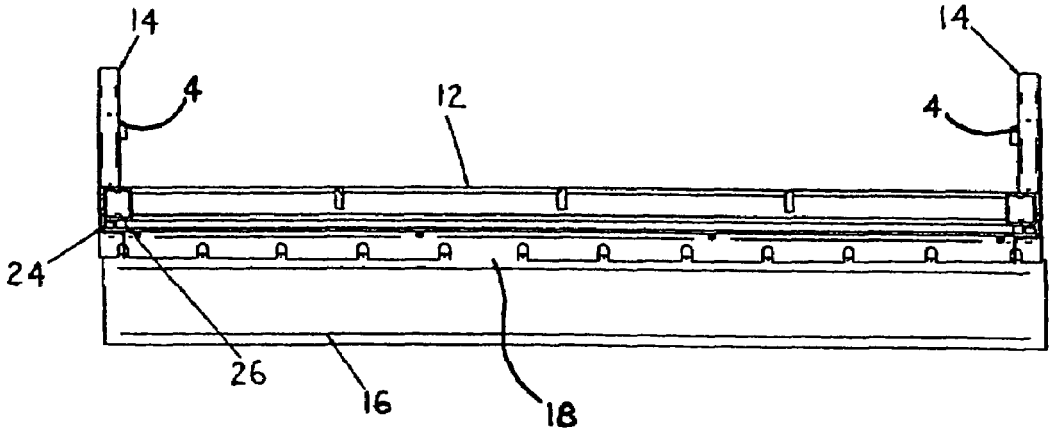
FIGS. 5A and 5B are longitudinal cross sectional views of a screen frame with a wedge block and a wedge block retaining bracket of a shaker separator as disclosed herein.
Figure 5B:
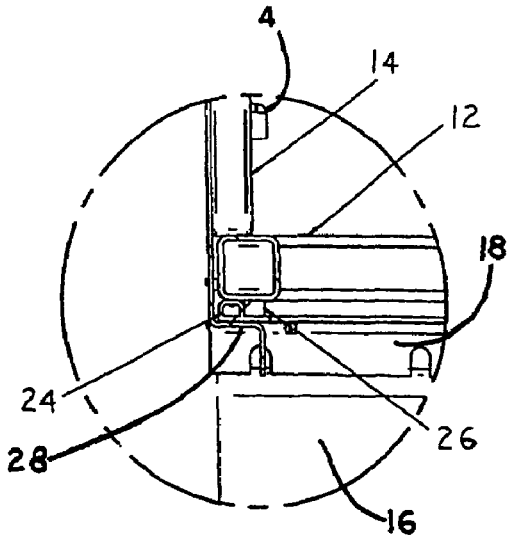

Turning now to FIG. 5A and FIG. 5B, illustrated is a longitudinal cross-sectional view along a line perpendicular to the line in FIG. 3, with FIG. 5B being a detailed view of the left edge of FIG. 5A.

Shown in FIG. 5A, the shaker screen (12) is held in place by the wedge block (14) working in frictional cooperation with the wedge block retainer bracket (4). The shaker separator includes a supporting cross member (16) upon which a shaker screen support (18) is mounted as disclosed above. Each of the side walls of the shaker separator (not numbered) includes a lateral shaker screen support (28). As shown in FIG. 5B, the frame of the shaker screen (12) is in sealing contact with a flexible gasket seal (24) (also referred to as the soft gasket) and a substantially inflexible gasket seal (26) (also referred to as the hard gasket) which are mounted on the lateral shaker screen support (28). This sealing contact is maintained by the pressure and frictional contact between and amongst the wedge block, the wedge block retainer bracket (4) and the frame of the shaker screen (12). As should be apparent to one of skill in the art, both the soft gasket and the hard gasket are substantially coextensive with the length of the lateral shaker screen support, which in turn is sized to substantially correspond to the size of the shaker screen. The concept of the interaction between the illustrated elements is to provide a sealing means between the shaker screen and the shaker separator so that fluids or other materials being separated do not by pass, leak through or break through the separation process. One of skill in the art should appreciate that one of the advantages of the presently illustrated embodiment is that the benefits of a soft gasket (i.e. substantially fluid tight seal) and a hard seal (i.e. frictional connectivity) are achieved by the combination of the two types of seals. That is to say, the soft seal forms a substantially fluid tight connection between the shaker screen and the shaker screen support while at the same time the hard seal provides for the spacing and support needed to effectively secure the shaker screen to the shaker separator. Thus this combination of sealing types allows for a substantially fluid tight seal combined with the rigidity needed to prevent the screen from loosening during operation of the shaker separator. Although the illustrative embodiment utilizes only one soft gasket and one hard gasket, an obvious variation of this design would be to utilize one or more soft gaskets alone or in combination with one or more hard gaskets. Further it should be noted that the relative order of the two gaskets as shown (i.e. the soft gasket outside of the hard gasket) may also be varied without substantially changing the desired result. It will also be noted by one of skill in the art that the width of the wedge block (14) substantially corresponds to the combined width of the soft gasket (24) and the hard gasket (26). Such a preferred arrangement optimizes the pressure that is used to form the seal between the shaker screen and the shaker separator.

Figure 7:
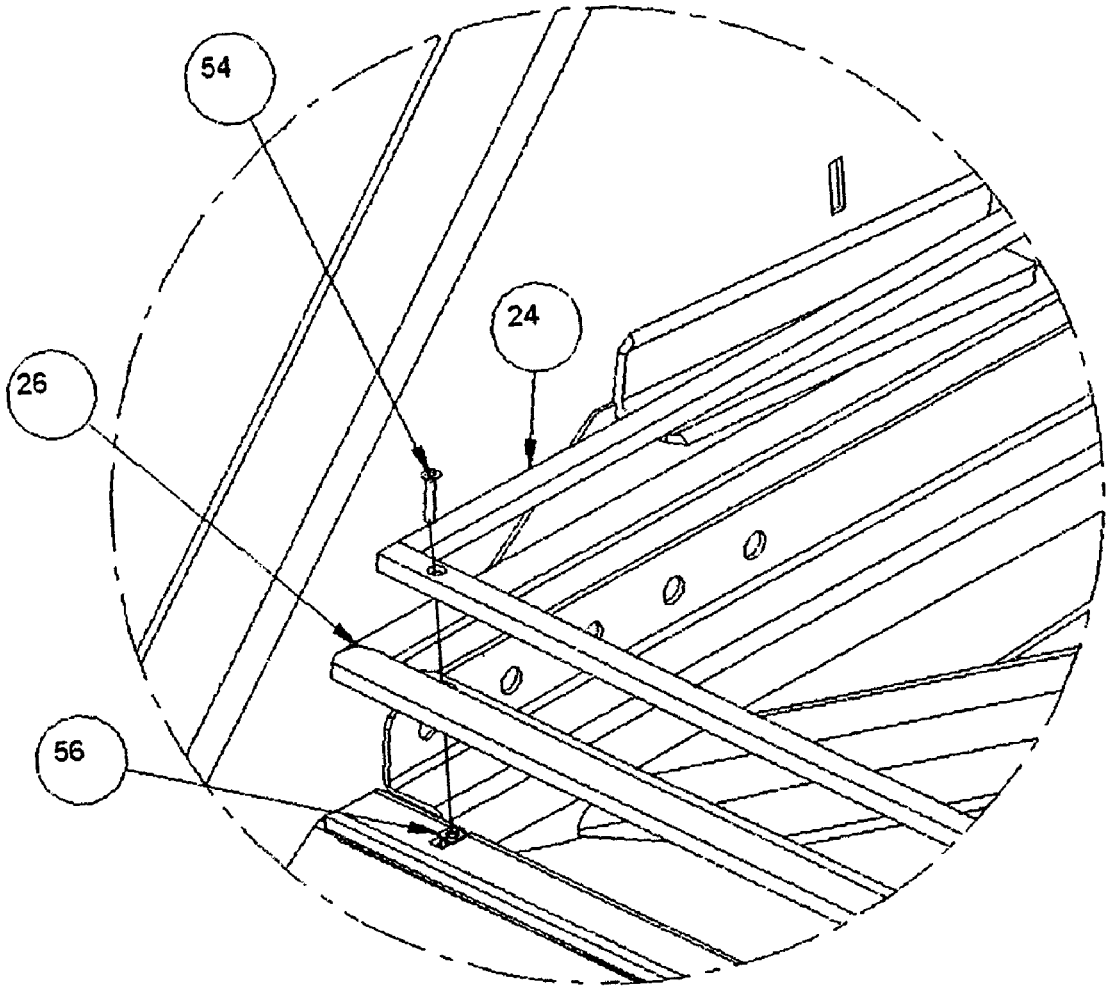
FIG. 7 is an exploded view of FIG. 4B.

Referring again to FIG. 4B and to FIG. 7, it may be seen how the flexible gasket (24) mounts to the shaker screen support (20). It will be appreciated by those of skill in the art that the same mounting system may be used to mount the flexible gasket (24) to the corresponding support around its length. The mounting system includes a plurality of fasteners (54), which are countersunk into the flexible gasket (24) such that the screen frame 12 abuts the gasket (24) around its bottom surface as shown in FIG. 4B. Each fastener is located through the shaker screen support (20) to retain the flexible gasket (24) to the support (20). An expandable collar (56) grips the shaker screen support (20) around the perimeter of a slot in the support through which the fastener is located. To remove the flexible gasket (24) from the shaker (10), a pry bar or similar levered device may be used to separate the flexible gasket (24) from the shaker screen support (20). The expandable collar (56) will either break to release the flexible gasket (24) or will be lifted through the slot in the shaker screen support (20). Thus, grinding or other "hot work" need not be performed to remove the flexible gasket (24) when it is to be replaced.

Figure 6A:
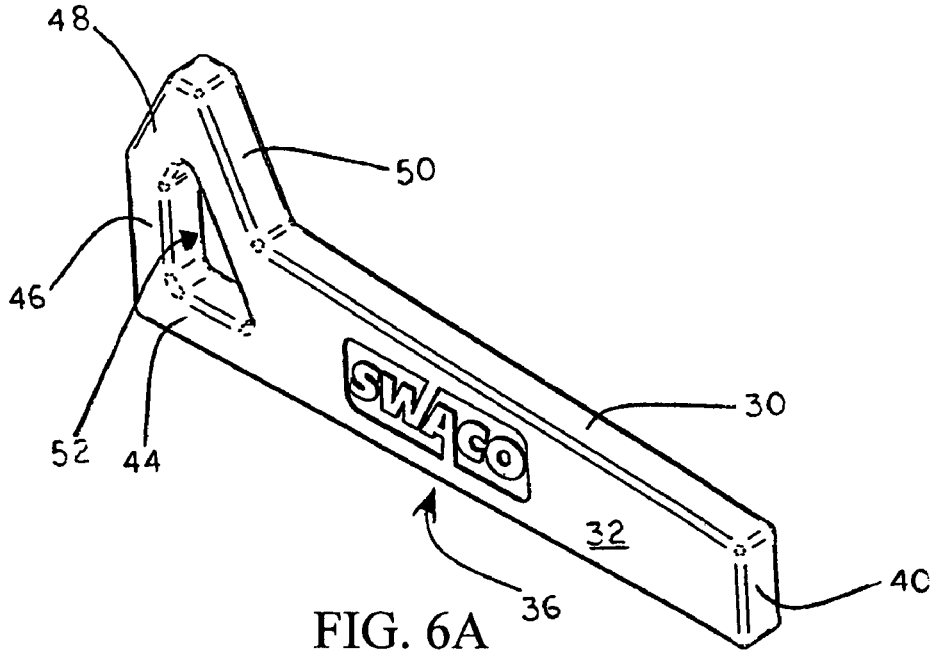
FIG. 6A, FIG. 6B and FIG. 6C are a close-up perspective, top and side view of a wedge block as disclosed herein.
Figure 6B:
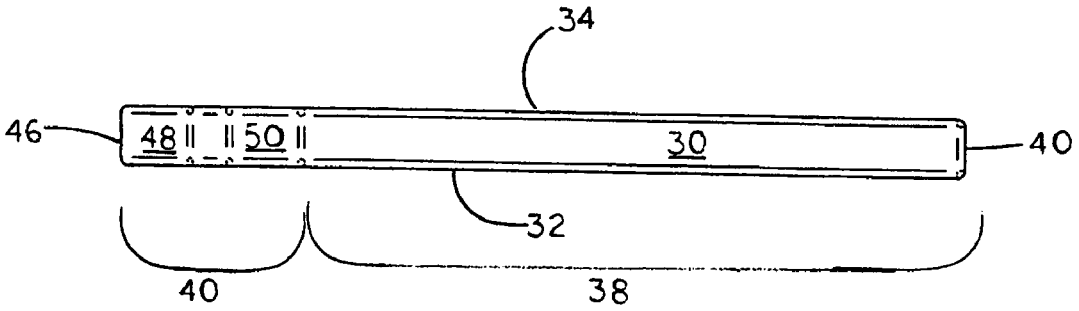
Figure 6C:
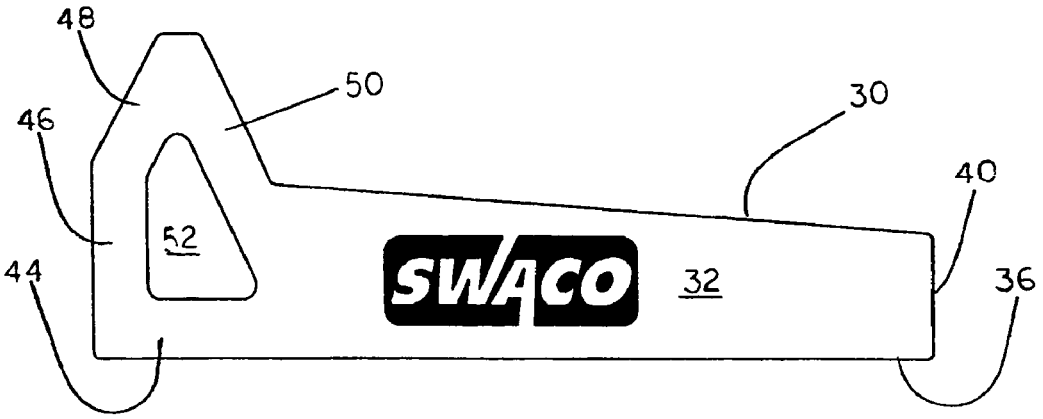

Looking now at FIG. 6A, FIG. 6B and FIG. 6C, provided are a perspective, top and side view showing the details of the unique and novel wedge block (14) of the claimed subject matter. The wedge block includes a wedge portion which is defined by a first upper surface (30), a first side surface (32), a second side surface (34) and a first lower surface (36). As illustrated, the first upper surface is connected to and substantially perpendicular to the two side surfaces and in turn the two side surfaces are connected to and substantially perpendicular to the first lower surface. Further it will be noted that the first upper surface is inclined relative to the first lower surface. The anterior portion of the wedge block (38), e.g. the pointed portion or "the nose", of the wedge is truncated by an anterior surface (40). The posterior portion of the wedge block (42), e.g. the wider portion or "the tail", of the wedge is designed in such a way as to obtain a number of advantages as will now be described. The tail of the wedge block is composed of a plurality of interconnected arms (44, 46, 48 and 50) which define an opening (52) in the tail of the wedge block. The opening may vary in size or shape, but in the preferred and illustrated embodiment the opening defines a gripping surface or hand hold which allows the user to easily grasp the wedge block. The interconnected arms (44, 46, 48 and 50) are arranged and positioned in a manner to enhance the ability of the shaker separator operator to easily engage and disengage the wedge block. As illustrated best in FIG. 6A, the lower arm (44) is connected to the first lower surface (36). Preferably the relative angle between the lower arm and the first lower surface is 0 degrees and thus the lower arm is an extension of the lower surface of the wedge block. Alternatively, the lower arm can be angled relative to the plane of the lower surface at an angle between 0 degrees and 60 degrees. The lower arm (44) is connected to an upright posterior arm (46). The relative angle of the lower arm and the upright posterior arm is shown as being substantially perpendicular. However, one of skill in the art should appreciate that this angle may be varied by up to +/−50 degrees and still achieve the same function. The upright posterior arm is in turn connected to a first striking arm (48). The first striking arm (48) is angled relative to the upright posterior arm. The relative angle of the first striking arm and the upright posterior arm is between 1 degree and 89 degrees, and preferably from 10 to 50 degrees and more preferably between 20 and 40 degrees. As illustrated, the angle is approximately 30 degrees. Thus when the shaker separator operator desires to fully engage the wedge block, a hammer may be used to strike the first striking arm thus driving the wedge into full engagement with the combination of the shaker screen and wedge block retainer bracket (as shown in FIG. 4A). One of skill in the art should appreciate that the upright posterior arm may also be used as a striking surface in a similar manner. The fourth arm forming the posterior end of the wedge block is the second striking arm (50) which is connected to the first striking arm and the first upper surface of the wedge block. The second striking arm (50) is angled relative to the first upper surface. The relative angle of the second striking arm and the first upper surface is between 30 degrees and 160 degrees, and preferably from 80 to 140 degrees and more preferably between 100 and 130 degrees. As illustrated the angle is approximately 120 degrees. Thus when the shaker separator operator desires to disengage the wedge block, a hammer may be used to strike the second striking arm thus driving the wedge out of full engagement with the combination of the shaker screen and wedge block retainer bracket.

As an alternative embodiment the posterior end of the wedge block may be formed of arms of sufficient thickness that there is little to no hole defined by the arms. In such an instance the arms merge into each other and thus form a substantially solid block. A further alternative is to eliminate one or more of the four arms described above. For instance the upright posterior arm and the first striking arm could be merged to form a single combined upright arm and first striking surface. A further alternative embodiment of the illustrated wedge block disclosed herein includes one or more teeth in the upper surface of the wedge block.

One of skill in the art should note the many unique and novel aspects of the wedge block disclosed herein when compared to the current state of the art wedge block. With reference to FIG. 1 (prior art wedge block) and FIG. 4A, one of skill in the art will immediately notice that the posterior end of the prior art wedge block is composed of a first surface that is substantially perpendicular to the lower surface of the wedge block and an angled surface that is angled towards the nose of the wedge block. Conspicuously absent is any surface useful for striking the wedge block in a manner to disengage it from the combination of the shaker screen and the wedge block retainer bracket. Further it will be noted that the posterior end of the wedge block disclosed herein is considerably wider and presents the operator with a larger surface profile for striking/urging the wedge block into a fully engaged position.

It should also be appreciated that the side surfaces of the illustrated wedge block are substantially flat and perpendicular. However, this is not critical in that the side surfaces may be concave or convex or even angled if so desired and still achieve the same desired functionality. One of skill in the art should also appreciate that the imprinted name on the side of the wedge block is merely ornamental and serves no utilitarian purpose.

Compositionally, the wedge block disclosed herein can be made of any suitable material such as wood, metal, natural or synthetic polymer, polymer composite materials, as well as combinations of these and the like. It is preferred that a polymer material be used, such as polyethylene, polypropylene, poly butylenes, polyurethane, as well as combinations of these and other similar materials. In view of the one piece construction of the disclosed wedge block, the entire block may be cast or injected molded as a single piece. However, if desired, the posterior and anterior ends of the wedge block may be made of differing materials depending upon the properties desired. For example the anterior end may be molded of a softer polypropylene material, but the posterior end made be mold of a rigid poly urethane with the two portions being joined in an appropriate manner. The detailed aspects of such operations should be well known to one of skill in the art of polymer and plastic molding.

While the apparatus, compositions and methods disclosed above have been described in terms of preferred or illustrative embodiments, it will be apparent to those of skill in the art that variations may be applied to the process described herein without departing from the concept and scope of the claimed subject matter. All such similar substitutes and modifications apparent to those skilled in the art are deemed to be within the scope and concept of the subject matter as it is set out in the following claims.

What is claimed is:

1. An assembly for sealing a shaker screen assembly in a shaker separator, wherein the shaker screen assembly includes a screen frame defining an area and a screen cloth affixed to the screen frame across the area, and wherein the shaker separator includes a plurality of shaker screen supports affixed between opposing side walls and corresponding to the screen frame and upon which the screen frame is positioned, the assembly comprising:

a substantially inflexible gasket affixed to each of the plurality of shaker screen supports and positioned between each shaker screen support and the corresponding screen frame;

a flexible gasket mounted to each of the plurality of shaker screen supports adjacent to the inflexible gasket and positioned between each shaker screen support and the corresponding screen frame;

a wedge block retainer bracket affixed to each side wall and spaced above the corresponding screen frame at an angle thereto;

a wedge block selectively locatable between each wedge block retainer bracket and the corresponding screen frame to provide a force to the corresponding screen frame sufficient to seat the screen frame against the inflexible gasket and to deform the flexible gasket to provide a fluid tight seal between the shaker screen supports and the screen frame.

2. The assembly of claim 1, wherein the inflexible gasket affixed to the shaker screen supports defines an enclosed area corresponding to the area defined by the screen frame and the flexible gasket mounted to the shaker screen supports defines an enclosed area around the enclosed area defined by the inflexible gasket.

3. The assembly of claim 1, wherein the flexible gasket mounted to the shaker screen supports defines an enclosed area corresponding to the area defined by the screen frame and the inflexible gasket affixed to the shaker screen supports defines an enclosed area around the enclosed area defined by the flexible gasket.

4. The assembly of claim 3 further comprising:

a plurality of fasteners operable to mount the flexible gasket to the shaker screen supports, wherein each fastener is countersunk into the flexible gasket and includes an expandable collar operable to hold the flexible gasket against the shaker screen support.

5. The assembly of claim 4, wherein the flexible gasket is removable from the shaker screen support by prying the flexible gasket away from the shaker screen support to dislodge the expandable collar from the shaker screen support.

6. The assembly of claim 1 wherein the wedge block further comprises:

a plurality of arms at a posterior portion of the wedge block forming an opening therein.

7. The assembly of claim 1 wherein the wedge block has a first width, the inflexible gasket has a second width, and the flexible gasket has a third width; and wherein the sum of the second width and the third width is substantially equal to the first width.

8. The assembly of claim 1, further comprising:

a second flexible gasket mounted to each shaker screen support and adjacent the inflexible gasket along a side thereof opposing the first flexible gasket.

9. An apparatus for securing a shaker screen to a shaker separator, wherein the shaker screen includes a screen frame and the shaker separator includes two opposing side walls and a plurality of shaker screen supports retained between the side walls, each shaker screen support configured to support a corresponding section of the screen frame, the assembly comprising:

a substantially inflexible gasket affixed to each shaker screen support and positioned between the screen support and the corresponding section of the screen frame;

a flexible gasket mounted to each shaker screen support and positioned between the screen support and the corresponding portion of the peripheral screen frame, wherein the flexible gasket is adjacent to the inflexible gasket;

at least one wedge block retainer bracket affixed to each of the opposed side walls and spaced above the screen frame;

a wedge block selectively drivable between each wedge block retainer and the screen frame, wherein the wedge block is in frictional cooperation with the wedge block retainer bracket to provide force sufficient to seat the screen frame against the inflexible gasket on each shaker screen support and to create a substantially fluid tight seal between the flexible gasket and the screen frame.

10. The apparatus of claim 9, further comprising:

a second flexible gasket mounted to each screen support and lateral screen support adjacent to the inflexible gasket, such that the inflexible gasket is between the flexible gaskets.

11. The apparatus of claim 9 wherein one wedge block along each side wall is selectively drivable into the space between the wedge block retainer bracket and the corresponding section of the screen frame from a first direction; and wherein the remaining wedge blocks are selectively drivable into the space between the wedge block retainer bracket and the corresponding section of the screen frame from a second direction opposite the first direction.

12. The apparatus of claim 8 further comprising:

a plurality of fasteners operable to mount the flexible gasket to the shaker screen supports, wherein each fastener is countersunk into the flexible gasket and includes an expandable collar operable to hold the flexible gasket against the shaker screen support.

13. The apparatus of claim 12, wherein the flexible gasket is removable from the shaker screen support by prying the flexible gasket away from the shaker screen support to dislodge the expandable collar from the shaker screen support.

14. A shaker separator comprising:

a pair of opposed side walls;

a plurality of support cross members extending between the opposed side walls;

a shaker screen support affixed to each support cross member;

a plurality of lateral shaker screen supports, wherein at least one lateral shaker screen support is affixed to each side wall;

a substantially inflexible gasket affixed to each of the shaker screen supports and lateral shaker screen supports;

a flexible gasket mounted to each of the shaker screen supports and lateral shaker screen supports and adjacent to the corresponding inflexible gasket;

a screen having a screen frame selectively located on the flexible and inflexible gaskets affixed to the opposing lateral screen supports and to the shaker screen supports between the side walls;

at least one wedge block retainer bracket affixed to each side wall and spaced above a corresponding section of the screen frame;

a wedge block selectively drivable between each wedge block retainer bracket and a corresponding portion of the screen frame, wherein the wedge block provides force to the corresponding section of the screen frame sufficient to seat the screen frame against the inflexible gasket and to compress the corresponding flexible gasket to provide a fluid tight connection between the shaker screen frame and the shaker screen support.

15. The shaker separator of claim 14 further comprising:

a plurality of fasteners operable to mount the flexible gasket to the shaker screen supports, wherein each fastener is countersunk into the flexible gasket and includes an expandable collar operable to hold the flexible gasket against the shaker screen support.

16. The shaker separator of claim 15, wherein the flexible gasket is removable from the shaker screen support by prying the flexible gasket away from the shaker screen support to dislodge the expandable collar from the shaker screen support.

17. The shaker separator of claim 16 further comprising:

a second flexible gasket mounted to each screen support and lateral screen support adjacent to the inflexible gasket, such that the inflexible gasket is between the flexible gaskets.

* * * * *